United States Patent [19]

Roy

[11] 3,937,319

[45] Feb. 10, 1976

[54] JEWELRY DISPLAY BOX

[75] Inventor: Armand W. Roy, Plainville, Mass.

[73] Assignee: Royal Hinge & Die Company, Inc., Plainville, Mass.

[22] Filed: Sept. 17, 1973

[21] Appl. No.: 398,237

[52] U.S. Cl. ..... 206/45.13; 63/30; 206/76

[51] Int. Cl.[2] ..... B65D 79/00

[58] Field of Search ..... 206/75, 76, 45.13; 63/30

[56] References Cited

UNITED STATES PATENTS

| | | | |
|---|---|---|---|
| 1,007,113 | 10/1911 | Kazian | 206/45.13 X |
| 1,240,671 | 9/1917 | Catala | 206/45.13 |
| 2,581,615 | 1/1952 | Whitelaw | 206/75 X |
| 2,991,876 | 7/1961 | Shiffman | 206/45.13 |

*Primary Examiner*—William T. Dixson, Jr.
*Assistant Examiner*—Stephen P. Garbe
*Attorney, Agent, or Firm*—Salter & Michaelson

[57] ABSTRACT

A display box for an ornamental article including pivotally interconnected top and bottom members in which a mounting member is located for receiving the article thereon, the mounting member being responsive to movement of the top member to an open position and movable therewith for presenting the ornamental article in a display position.

6 Claims, 7 Drawing Figures

JEWELRY DISPLAY BOX

BACKGROUND OF THE INVENTION

The present invention relates to a box for storing and displaying an ornamental article and has particular application for use with finger rings.

The display box for finger rings in common use has normally included some form of a hook, finger or cushion having a slot formed therein for receiving the shank of the ring so as to locate it in a secure position in the box and also for displaying the ornamental portion of the finger ring when the cover of the box is in the open position. These prior known box constructions have attempted to locate the finger ring in the bottom member of the box in such a position that when the top member is opened, the finger ring will be exposed for view. Although these prior known box constructions for displaying finger rings have been acceptable in use and have normally provided a convenient means for locating the ring in the bottom member of the box for storage and for viewing when the box was open, the full extent of the ornamental portion of the ring was not always visible; and it was usually necessary to physically remove the ring from the box so that all of the ornamental features thereof could be observed. When the prior known box was located in a display or show case, the removal of the box was not always feasible; and if a clerk was not available, a customer viewing the ring could not always see all of the ornamental details thereof.

SUMMARY OF THE INVENTION

The present invention relates to a display box for an ornamental article and includes a bottom member and a top member hingedly interconnected to said bottom member for movement to either an open display position or to a closed position. In order to locate an ornament in a box for viewing therein when the top member is located in the open position, a mounting member is provided and receives the article thereon, the mounting member being located in the box adjacent to the axis of the hinge that interconnects the top and bottom members. The mounting member is responsive to movement of the top member and is movable therewith so as to project the ornament upwardly and forwardly to a display position for easy viewing when the box is fully opened. The mounting member is constructed for normally receiving a ring thereon and for this purpose is formed with a slot which receives the shank of the ring. The mounting member may be conveniently interconnected to a flexible covering secured within the box members adjacent to the hinge axis thereof or may include fingers that engage the hinge and is movable therewith when the top member is moved from the closed to the open position.

Accordingly, it is an object of the present invention to provide a display box for an ornamental article in which a mounting member is located in the box and receives the ornamental article thereon, and is movable in response to the opening of the box for presenting the ornamental arti' :n a display position for easy viewing.

Another object of the invention is to provide a display box for a finger ring that includes a mounting member on which the finger ring is located and that is responsive to movement of the top member of the box from a closed to an open position for presenting the finger in a position of display.

Still another object is to provide a display box for a finger ring that includes a bottom and top member that are interconnected by a hinge, a mounting member being located in the display box adjacent to the hinge axis and being responsive to movement of the top member for moving the ring to a display position when the top member is fully opened.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE EMBODIMENTS OF THE INVENTION

Figure 1:
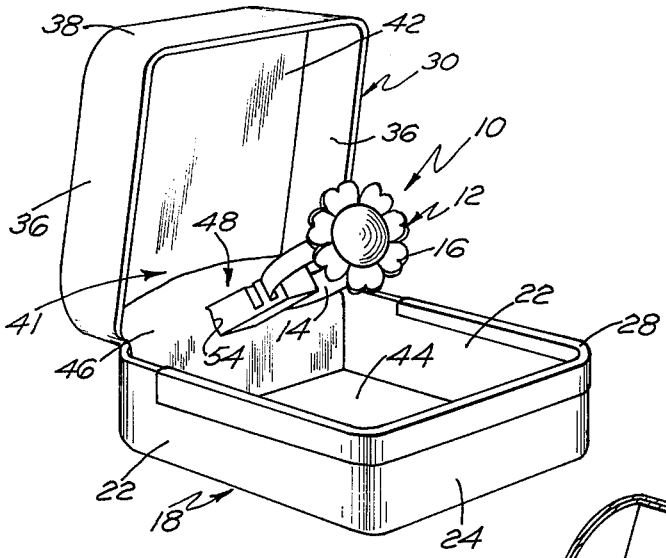
FIG. 1 is a perspective view of the display box embodied herein as located in the open position and illustrating the manner in which a finger ring is presented for viewing therein.

Referring now to the drawing and particularly to FIG. 1, the jewelry display box embodied in the present invention is illustrated and is generally indicated at 10. As shown, the display box 10 has particular application for the packaging and display of a finger ring that is generally indicated at 12 and that includes a shank 14 and ornamental portion 16. However, it is understood that the display box 10 may be utilized for the packaging and display of ornamental articles other than finger rings.

The display box 10 includes a bottom shell or member generally indicated at 18 that is preferably formed of a metal material and is drawn to the required shape and configuration. The bottom shell or member includes a bottom wall 20, side walls 22, a front wall 24 and a rear wall 26. A suitable outer covering for the bottom shell 18 may be applied to the walls thereof, and a rim 28 is mounted on the upper edges of the side walls 22 and the front wall 24 as is commonly known in the manufacture of jewelry display boxes.

A top shell or member generally indicated at 30 is hingedly interconnected to the bottom shell 18 by a spring hinge 32 that has a spring 33 of common construction mounted thereon. The top shell 30 includes a top wall 34, side walls 36, front wall 38 and rear wall 40; and an ornamental covering similar to that covering the bottom shell 18 also covers the outer surfaces of the walls of the top shell 30.

Located interiorly of the top and bottom shells and covering the inner surfaces thereof is a flexible insert generally indicated at 41, the upper surfaces of which have a flocking material applied thereto. The flexible insert 41 includes a top portion 42, a bottom portion 44, and an intermediate portion 46 interconnecting the top and bottom portions, the top portion 42 of the insert being located in engaging relation with the inner surface of the top wall 34 of the top shell 30, while the bottom portion 44 of the insert is located in flush engagement with the inner surface of the bottom wall 20 of the bottom shell 18. The intermediate portion 46 of the insert extends over and covers the hinge 32 and is shiftable in response to pivotal movement of the top shell 30 from an open or to a closed position relative to the bottom shell 18.

Figure 3:
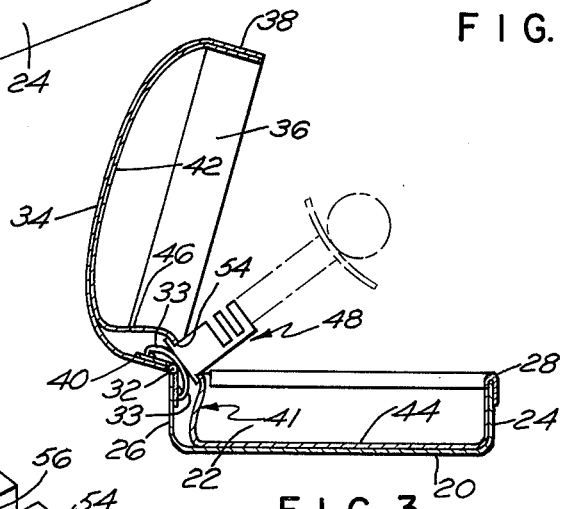
FIG. 3 is a view similar to FIG. 2 and showing the display box in the open position.
Figure 4:
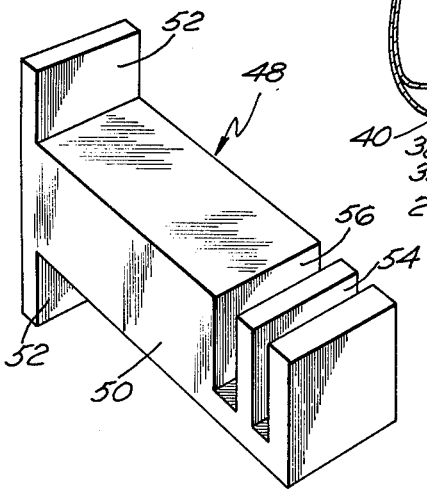
FIG. 4 is a perspective view of the mounting member as illustrated in FIGS. 2 and 3.

In order to locate the ring 12 in an easily viewable display position when the top shell 30 is moved to the open position as illustrated in FIGS. 1 and 3, a mounting member generally indicated at 48 is provided and is fixed to the intermediate portion 46 of the flexible insert 41. As shown more clearly in FIG. 4, the mounting member 48 includes a body portion 50 having a generally square, cross-sectional configuration and is formed with flanges 52 on the inner end thereof. An opening 54 that is substantially square in configuration is formed in the intermediate portion 46 of the flexible insert 41 and receives the body portion 50 of the mounting member 48 therein. The flanges 52 abut the rear surface of the intermediate portion 46 of the insert 41 adjacent to the opening 54 and prevent withdrawal of the mounting member 48 through the opening 54. The mounting member 48 in effect is thus mounted in the intermediate portion 46 and is movable therewith as will be described. As further illustrated, the longitudinal axis of the mounting member 48 is perpendicular to the hinge axis of the shells 18 and 30 and substantially bisects the hinge axis to locate the mounting member 48 intermediate the side walls of the shells.

In order to receive the shank 14 of the ring 12 thereon, the mounting member 48 is formed with spaced, transversely extending slots 54 and 56. The width of the slot 54 is somewhat less than that of the slot 56 and accommodates a ring shank of appropriate thickness therein. The slot 56 accommodates a ring shank having a thickness greater than that received in the slot 54. As shown in FIG. 1, with the shank 14 of the ring 12 received in the slot 54, the ornamental portion 16 of the ring is disposed substantially forwardly of the outermost end of the mounting member 48.

Figure 2:
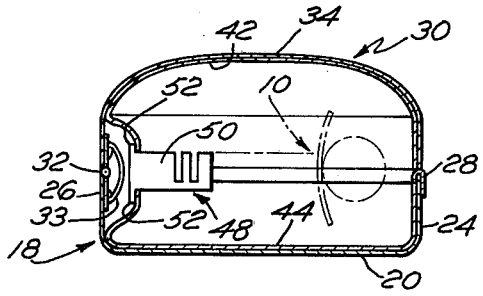
FIG. 2 is a sectional view of the display box in the closed position thereof and showing the location of one form of a mounting member therein.

In use, the ring 12 is mounted in position on the mounting member 48 by location of the shank 14 in the slot 54. As described above, if the thickness of the shank 14 were greater than that of the slot 54, then the shank 14 would be received in the slot 56. With the ring 12 mounted in place on the mounting member 48, and with the top shell 30 located in a closed position with respect to the bottom shell 18, the longitudinal axis of the mounting member 48 is substantially horizontal. As the top shell 30 is moved to the closed position, the intermediate portion 46 of the insert 41 is responsive thereto for locating the mounting member 48 in the position as shown in FIG. 2, wherein the mounting member 48 is generally horizontal and the ring 12 located thereon is positioned as shown in phantom in FIG. 2. When the top shell 30 is moved to the open position illustrated in FIG. 3, the intermediate portion 46 of the insert is shifted in response thereto to move the mounting member 48 therewith such that the longitudinal axis of the mounting member is pivoted upwardly so that it projects substantially intermediate the top and bottom shells. The ring 12 located on the mounting member 48 is moved therewith and is presented in an upper display position as shown in FIGS. 1 and 3. In this position all of the details of the ring 12 are clearly visible; and if required, the ring 12 may be easily removed from the box 10 by grasping the shank 14 and pulling upwardly so that the ring is removed from the mounting member 48.

Figure 5:
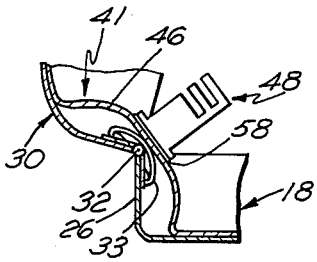
FIG. 5 is a fragmentary sectional view similar to FIG. 3 and illustrating a modified form of locating the mounting member in the display box.

Referring now to FIG. 5, a modified method of securing the mounting member 48 to the intermediate portion 46 of the insert 41 is illustrated. In this form of the invention the intermediate portion 46 of the insert is formed inperforate and without the opening 54. An adhesive is applied to the rear surfaces of the flanges 52 and the rearmost end of the body portion 50 of the mounting member 48 which are then affixed directly to the outer surface of the intermediate portion 46. In this connection, the longitudinal axis of the mounting member 48 is located substantially perpendicular to the hinge axis of the shells and also substantially bisects the hinge axis. It is seen that the mounting member is secured directly to the outer surface of the intermediate portion 46 of the insert 41 and is responsive to movement thereof; and as the top shell 30 is opened or closed, the mounting member shifts with the intermediate portion 46 to locate the ring mounted thereon in either the stored or display position as required.

Figure 7:
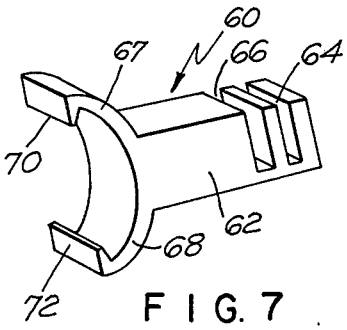
FIG. 7 is a perspective view of the modified mounting member as shown in FIG. 6.
Figure 6:
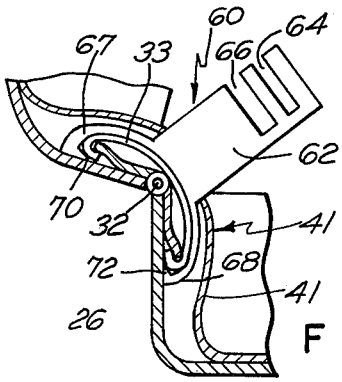
FIG. 6 is an enlarged fragmentary sectional view similar to FIG. 5 illustrating a further modified form of mounting member.

Referring now to FIGS. 6 and 7, a further modified form of the mounting member is illustrated as used with the box 10 and includes a mounting member generally indicated at 60. The mounting member 60 is formed with a body portion 62 that is square in cross-sectional configuration. Formed transversely in the body portion 62 adjacent to the outermost end thereof are slots 64 and 66 that receive a ring shank therein. Integrally joined to the body portion 62 of the mounting member 60 at the inner end thereof are curved jaws 67 and 68 that have inwardly extending fingers 70 and 72, respectively, that are fitted over the ends of the spring 33 as formed on the spring hinge 32. As mounted on the spring 33, the longitudinal axis of the mounting member 60 is also perpendicular to the axis of the spring hinge 32 and substantially bisects the spring hinge. In use, the mounting member 60 is movable with the spring 33 of the spring hinge 32 as the top shell 30 is moved to and from the closed and open positions; and as shown in FIG. 6, with the top shell located in the open position, the mounting member 62 projects upwardly at an angle relative to the bottom shell 18 and in this position locates a ring as mounted thereon in a display position.

In the various forms of the mounting member as illustrated herein, the longitudinal axis thereof is located such that it is perpendicular with respect to the hinge axis of the box shells 18 and 30. The longitudinal axis of the mounting member in the various forms illustrated also substantially bisects the hinge axis of the box shells. With the mounting member 48 mounted on the intermediate portion 46 of the flexible insert as shown in FIGS. 3 and 5 or with the mounting member 60 mounted on the spring 33 of the spring hinge as illustrated in FIG. 6, the movement of the mounting member is correlated with respect to the movement of the top shell 30 as it is moved from the open or to the closed position thereof. With the box in the closed position, the longitudinal axis of the mounting member is substantially horizontal, which locates the ring thereon within the confines of the shells. When the top shell 30 is moved to the open position thereof, the mounting member is lifted upwardly to an inclined position as shown in FIGS. 1, 3, 5 and 6 to present the ring in a display position.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A display box for an ornamental article, comprising a bottom member having a bottom wall, a top member hingedly interconnected to said bottom member for movement to an open or closed position relative thereto and having a top wall, a hinge joined to said top and bottom members, a mounting member for receiving said article thereon and located in said box adjacent to the axis of said hinge, means secured to said mounting member and responsive to movement of said top member for locating said article as received on said mounting member in a storage position within said top and bottom members when the box is closed, or in an upper exposed display position between said top and bottom members when the box is open, said mounting member including an elongated body portion, the longitudinal axis of which is perpendicular to the hinge axis of said top and bottom members, an extension of the longitudinal axis of said mounting member substantially bisecting the hinge axis of said top and bottom members, said locating means including a flexible insert covering at least the hinge that interconnects said members, said mounting member being secured to said flexible insert and projecting therefrom at substantially right angles thereto, and an opening formed in said flexible insert, said mounting member being received in said opening having a flange formed thereon that is located on the underside of said flexible member for preventing withdrawal of said mounting member through said opening.

2. A display box for an ornamental article, comprising a bottom member having a bottom wall and a rear wall, a top member hingedly interconnected to said bottom member for movement to and from an open or closed position relative thereto and having a top wall and rear wall, a spring hinge secured to the rear walls of said bottom and top members for urging said top and bottom members to the open or closed position relative to each other, a flexible insert covering the interior surfaces of said bottom wall and top wall and extending over the rear walls of said top and bottom members to conceal the spring hinge, and an elongated mounting member extending outwardly of said flexible member in a direction generally perpendicular thereto and being formed of a relatively rigid material, the longitudinal axis of said mounting member being perpendicular to the axis of said spring hinge, an extension of the longitudinal axis of said mounting member substantially bisecting the hinge axis of said top and bottom members.

3. A display box as set forth in claim 2, said mounting member being secured directly to the flexible insert on the exterior surface thereof.

4. A display box as set forth in claim 2, said locating means including oppositely extending jaws formed on the inner end of said mounting member, said jaws engaging said hinge for securing said mounting member thereon and for movement therewith as the top member is moved from the open or to the closed position thereof.

5. A display box as set forth in claim 2, at least one slot formed in said mounting member transversely of the longitudinal axis thereof for positively receiving the article therein for locating the article in engagement with said mounting member.

6. A display box as set forth in claim 5, said article being a ring that includes a circular shank portion and an ornament joined to said shank portion, said shank portion being received in said slot for locating said ornament forwardly of said mounting member, wherein said ornament is clearly visible when said top member is moved to the open position.

* * * * *